United States Patent [19]

Hawkins et al.

[11] 4,085,805

[45] Apr. 25, 1978

[54] EARTH WORKING MACHINE WITH ELEVATION CONTROL FOR TOOL THEREOF

[75] Inventors: Royal R. Hawkins, Bloomington, Minn.; Leland E. Kuntz, Arlington Heights, Ill.

[73] Assignee: Honeywell Inc., Minneapolis, Minn.

[21] Appl. No.: 652,010

[22] Filed: Jan. 26, 1976

[51] Int. Cl.[2] ..... E02F 3/76

[52] U.S. Cl. ..... 172/4.5

[58] Field of Search ..... 172/4.5; 37/DIG. 20; 404/84; 73/1 E; 318/578, 587, 625, 632; 214/762, 763

[56] References Cited

U.S. PATENT DOCUMENTS

| | | | |
|---|---|---|---|
| 3,856,089 | 12/1974 | Rivinius | 172/4.5 |
| 3,896,899 | 7/1975 | Scholl | 172/4.5 |

*Primary Examiner*—Richard T. Stouffer

*Attorney, Agent, or Firm*—Trevor B. Joike

[57] ABSTRACT

A system is disclosed for maintaining, in a predetermined horizontal orientation, the support assembly for supporting an earth working tool to an earth working machine and comprises a cam surface and a cam sensor mounted between the support assembly and the machine wherein the cam sensor has a follower for following the cam surface to maintain the support assembly in its predetermined horizontal orientation. The system for maintaining the support assembly in a predetermined horizontal orientation is proportional.

11 Claims, 3 Drawing Figures

EARTH WORKING MACHINE WITH ELEVATION CONTROL FOR TOOL THEREOF

BACKGROUND OF THE INVENTION

This invention relates to a control system for maintaining, in a prescribed horizontal orientation, the assembly which supports an earth working tool to an earth working machine. For purposes of explanation, this invention will be described as controlling the blade circle and drawbar assembly for supporting a grader blade to a grading machine.

In view of today's road construction requirements, particularly high speed travel over modern highways, the demand for greater accuracy in preparing road beds for surfacing is substantial. At the same time, the grading operation must be accomplished quickly and efficiently in order to cope with the long distances which today's modern highways are to span. The grading operation performed by today's grading machines must result in quick and efficient operation to yield a highly accurate graded road bed.

In the modern grading machine, the grader blade has many degrees of freedom of movement. For example, the grader blade can be raised or lowered for controlling the grade of the blade, can be raised at one end and/or lowered at the other end for controlling the transverse slope of the blade, can be shifted from side to side to make cuts adjacent to the machine and can be rotated about an axis perpendicular to the blade circle. As long as the blade circle and drawbar assembly of the grading machine is maintained parallel to the line of flight of the machine (i.e., parallel to the cut surface), any rotation about the axis perpendicular to the blade circle will not alter the transverse slope of the blade. However, if the blade circle and drawbar assembly is not parallel to the line of flight of the machine, such rotation will result in a change in the transverse slope of the blade.

One prior art method for trying to compensate for such changes in slope is to mount the slope sensor on the blade circle itself. However, because the sensor is mounted on the blade circle, the slope sensor rotates as the circle rotates. The slope sensor, therefore, does not experience the transverse slope of the blade when projected upon a plane which is perpendicular to the line of flight of the machine. That is, the output from the slope sensor becomes both a function of the transverse slope of the blade and the angle of the fore-aft axis of the machine with respect to a true horizontal axis.

One successful method of compensating for the changes in transverse slope of the grader blade as the blade circle is rotated, is shown in patent applications 408,778 filed Oct. 23, 1973, now abandoned and 548,500 filed Feb. 10, 1975, now abandoned, both of which are assigned to the assignee of the present invention. The device shown in those applications comprises a platform for mounting the slope sensor and a mechanism for providing a correction factor to the slope of the platform dependent upon blade circle rotation. In this manner, the slope sensor is mounted in a fixed relationship with the line of flight of the machine such that it is now influenced by the angle of the fore-aft axis of the machine with respect to a true horizontal axis.

Another alternative, known in the prior art, is to maintain the blade circle and drawbar assembly parallel to the machine frame by the use of an on-off system or a complicated parallelogram linkage proportional control system having a parallelogram linkage connected between the front of the machine and the tow point of the drawbar for controlling a hydraulic cylinder connected between the drawbar and the tow point. On-off systems are incapable of providing both high positioning speeds and a narrow dead band (dead band here is defined as the distance the switch operator travels between the closed and opened positions of the switch). If an on-off system is operated at high speed and a narrow dead band, the system tends to overshoot the control point, causing cyclical operation. It is necessary, therefore, to operate the system at a high speed and wide dead band which allows too much error or at a low speed and a narrow dead band which results in a slow response. The proportional system of the prior art relies upon a very complicated parallelogram linkage. The prior art system also does not allow the horizontal orientation of the blade circle and drawbar assembly to be predetermined.

SUMMARY OF THE INVENTION

The present inventionprovides a system for maintaining the blade circle and drawbar assembly in a prescribed horizontal orientation. A cam surface and cam sensor means are mounted between the blade circle and drawbar assembly and the machine frame and the cam sensor means has a cam follower for following the surface of the cam. The cam sensor means provides an output dependent upon the deviation of the blade circle and blade drawbar assembly from the prescribed horizontal orientation for controlling the horizontal orientation of the blade circle and drawbar assembly.

One of the advantages of the present invention is that the cam surface can be contoured for prescribing the horizontal orientation of the blade circle and drawbar assembly. The cam surface can be contoured to maintain the blade circle and drawbar assembly parallel to the machine frame or, preferably, can be contoured to maintain the blade circle and drawbar assembly parallel to the line of flight of the machine. Maintaining the blade circle and drawbar assembly parallel to the machine frame allows for deviations in the transverse slope of the blade as the height of the front end of the machine changes as it meets rises and dips in the surface to be graded. By maintaining the blade circle and drawbar assembly parallel to the line of flight of the machine, the rises and dips experienced by the front of the machine are compensated for and the transverse slope of the blade is made substantially free from such rises and dips.

Furthermore, the system as disclosed is proportional which eliminates many of the disadvantages of the on-off system. In a proportional control system, large errors or deviations between the actual horizontal orientation of the blade circle and drawbar assembly from its prescribed horizontal orientation results in high speed correction and, as corrective action is taken and the error is reduced, the correction speed is reduced. Thus, overshoot and cycling are substantially eliminated.

BRIEF DESCRIPTION OF THE DRAWINGS

These and other features and advantages will be seen from a detailed description of the drawings in which.

DETAILED DESCRIPTION OF THE DRAWINGS

Figure 1:
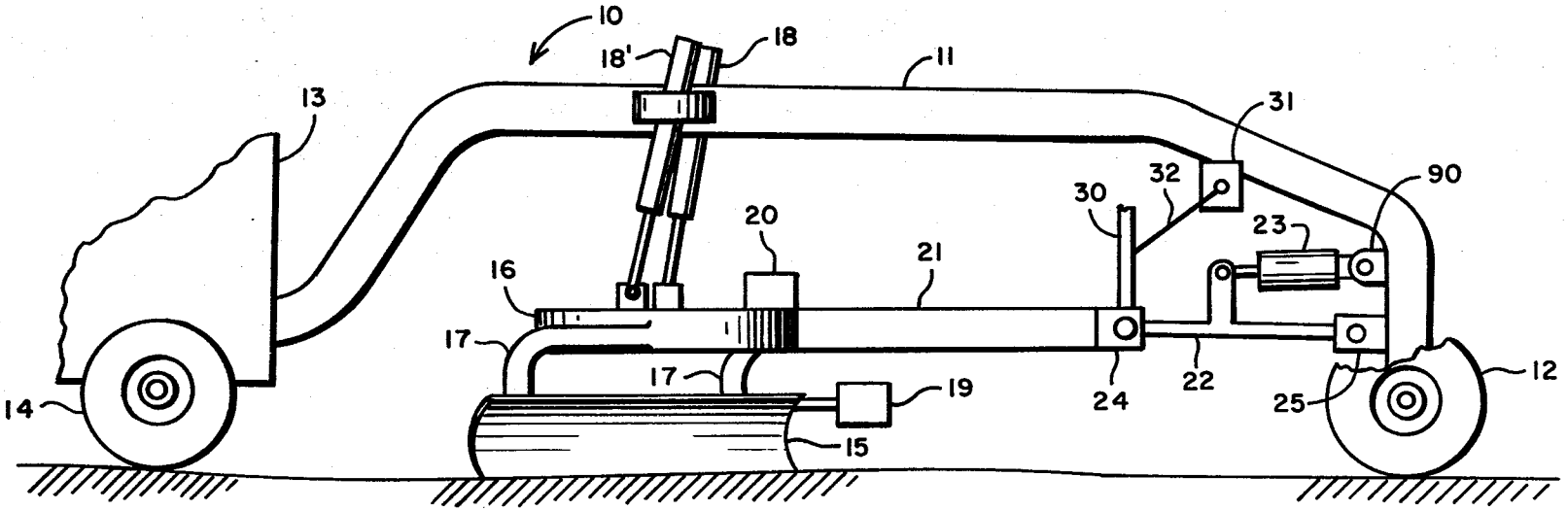
FIG. 1 is a side elevational partial view of a road grader incorporating the present invention.

In FIG. 1, a grader 10 is shown having a main frame 11 of the usual design supported at the front end by wheels 12 and at the back end by an engine housing 13 supported on wheels 14. A grader blade 15 is supported on a blade circle 16 by supports 17. A pair of conventional hydraulic rams or cylinders 18 and 18' are conventionally connected to the main frame 11 and to the blade circle 16 for raising and lowering the blade 15, circle 16 for grade control and for controlling the transverse slope of the blade 15. A grade sensor 19 is conventionally mounted to the grader blade and a slope sensor 20 is conventionally supported by the blade circle 16.

The blade circle 16 is supported at the front end of the machine frame 11 by a drawbar 21 and link 22. The link 22 is connected to the drawbar 21 by a conventional ball and socket arrangement 24 and is connected at its other end to the front of the machine by a conventional hing arrangement 25. A hydraulic cylinder 23 is connected between the front end of the machine and the link 22 for raising and lowering the front end of the drawbar 21 to maintain the blade circle and drawbar assembly in a prescribed horizontal orientation. The blade circle 16 and drawbar 21 assembly form an earth working tool support assembly for supporting the earth working tool 15 to the main frame 11 of the machine. A cam surface and cam sensor means are mounted between the main frame and the blade circle and drawbar assembly.

Specifically, the cam surface 30 is suitably mounted on the front end of the drawbar 21 and a cam sensor 31 is attached to the main frame 11. The cam sensor means 31 may be a potentiometer having a wiper arm connected to cam follower 32 and provides an output dependent upon the deviation of the blade circle and drawbar assembly 16, 21 from its prescribed horizontal orientation.

Figure 2:
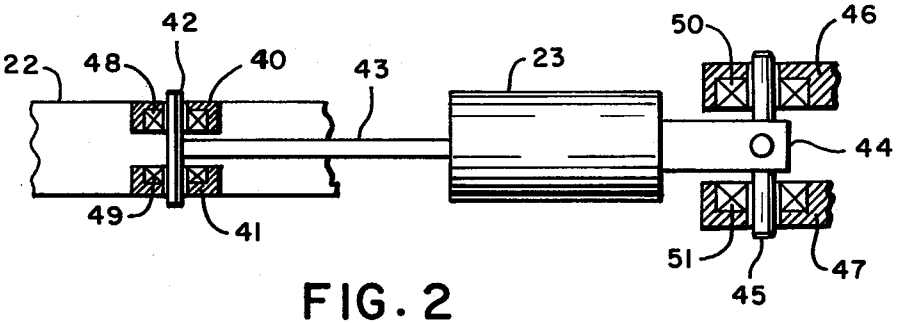
FIG. 2 is a top view of the connection of the front end hydraulic cylinder to the machine frame and to the linkage which supports the drawbar to the machine frame; and, FIG. 3 is a schematic diagram of the circuit for controlling the blade circle and drawbar assembly.

As shown in FIG. 2, the link 22 may have a pair of flanges 40 and 41 each having a hole therein for receiving the end 42 of the extending and retracting rod 43 of hydraulic cylinder or ram 23. The hydraulic cylinder 23 has a projection 44 at its other end with a shaft 45 extending therethrough and through suitable holes in flanges 46 and 47 of the front of the main frame 11. Suitable bearings 48–51 may be provided for allowing easier rotation of the end 42 and shaft 45.

As the rod 43 is extended by the hydraulic cylinder 23, the front end of drawbar 21 is lowered and as rod 43 is retracted the front end of drawbar 21 is raised.

Figure 3:
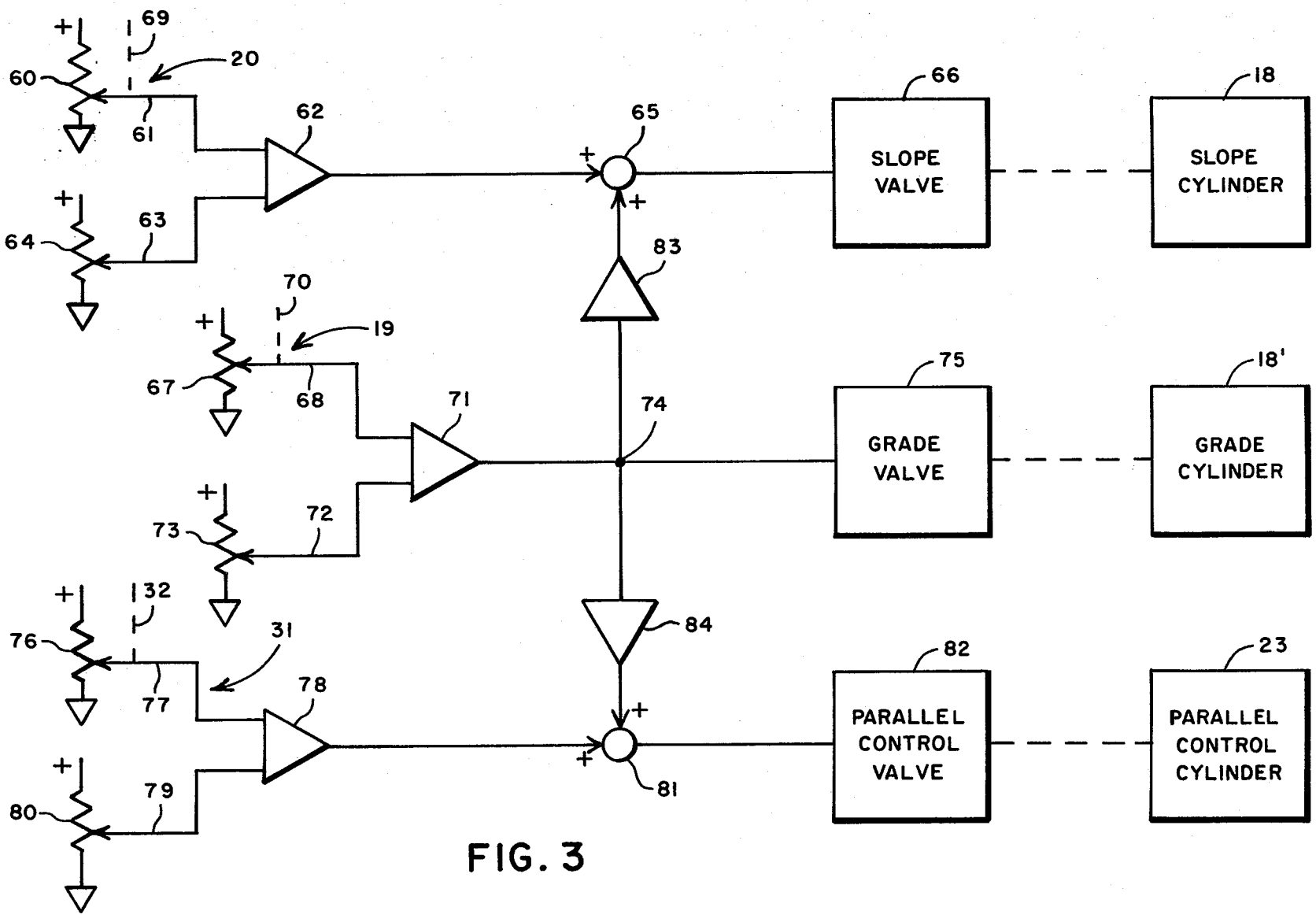

FIG. 3 shows the schematic of the circuit for accomplishing the various control functions of the control system. As shown, the slope sensor 20 comprises a potentiometer having a resistance portion 60 connected between a positive source and ground and a wiper arm 61 which is gravity operated (gravity reference being shown by dashed line 69). Wiper arm 61 is connected to one input of an amplifier 62, the other input of which is connected to wiper arm 63 of a setpoint potentiometer 64 connected between a positive source and ground. The proportional output of amplifier 62 is connected to a slope control valve 66 for proportionally controlling the supply of hydraulic fluid to the slope cylinder 18 on the far side of the machine shown in FIG. 1.

The grade sensor 19 comprises a potentiometer having a resistance 67 connected between a positive source and ground and a wiper arm 68 which is driven by a reference which may be a string line (shown diagrammatically by dashed line 70). Wiper arm 68 is connected to one input of amplifier 71 the other input of which is connected to the wiper arm 72 of a setpoint potentiometer having resistance 73 connected between a positive source and ground. The proportional output of the amplifier 71 is connected to a circuit junction 74 which in turn is connected to the grade valve 75 which proportionally controls the hydraulic fluid to the grade cylinder which may be the cylinder 18' on the near side of the machine as shown in FIG. 1.

The cam sensor means 31 comprises a potentiometer having resistance 76 connected between a positive source and ground and a wiper arm 77 which is responsive to the follower 32 (shown as a dashed line) operated by the cam surface 30. The wiper arm 77 is connected to one input of amplifier 78 the other input of which is connected to the wiper arm 79 of a setpoint potentiometer having resistance 80 connected between a positive source and ground. The proportional output of the amplifier 78 is connected to a summing junction 81 having an output connected to the parallel control valve 82 which proportionally controls the hydraulic fluid to the parallel control cylinder 23.

To provide a feed-forward or anticipating signal for changes in grade to the slope control cylinder 18, an amplifier 83 is connected between junction 74 and summing junction 65, and, likewise, to provide a feed-forward or anticipating signal from the grade sensor to the parallel control cylinder 23, an amplifier 84 is connected between the junction 74 and summing junction 81.

If the slope sensor 20 senses a change in slope of the blade circle 16, the wiper arm changes position with respect to resistance 60 to provide an appropriate proportional signal to amplifier 62, the output of which is changed by an amount proportional to the deviation in slope from the setpoint to modulate the valve 66 to drive the slope cylinder 18 to correct for the change in slope of the blade circle 16.

Any deviation of the blade circle 16 and drawbar 21 assembly from the prescribed horizontal orientation results in movement of the follower 32 to change the position of the wiper arm 77 with respect to the potentiometer 76 to provide an appropriate proportional change in the input to the amplifier 78. This change in input results in a proportional change in output from amplifier 78 which results in the parallel control valve 82 modulating the flow of hydraulic oil to the parallel control cylinder 23 to reorient the blade circle 16 and drawbar 21 assembly. The surface of cam 30 may be contoured to predetermined the horizontal orientation of the blade circle and drawbar assembly. Depending on the contour, this assembly can be controlled parallel to the machine main frame or, preferably, parallel to the machine line of flight or any other predetermined orientation.

If the grade sensor 19 senses a deviation between the blade 15 and the reference, which may be a string line, the wiper arm 68 assumes a new position relative to the resistance 67 to modify the input to the amplifier 71. This modification results in a proportional change in the output which drives the grade cylinder 18' through the grade valve 75 to correct the near side of the blade circle 16. At the same time, the slope sensor 20 senses a change in slope of the blade circle 16 to drive its cylinder 18 to correct the elevation of the other side of the blade circle 16. Moreover, the proportional change in the output from the amplifier 71 is supplied to the slope control valve 66 through amplifier 83 and junction 65 which allows the slope valve 66 and slope control cylinder 18 to anticipate the fact that it will be receiving a change in output also from amplifier 62. Likewise, a change in output from amplifier 71 is connected to the parallel control valve 82 through amplifier 84 and summing junction 81 to allow the parallel control valve 82 to anticipate a change in output from amplifier 78.

Thus, if the string line or reference dictates a deeper cut by the blade 15, the grade sensor 19 begins to drive the blade circle 16 downward. As the blade circle 16 and drawbar 21 begin to rotate downward around the ball and socket joint 24, the wiper arm 32 is raised to change the output of amplifier 78 to begin to drive the parallel control valve 82 and the parallel control cylinder 23 to push the front end of the drawbar down to maintain the horizontal orientation of the blade circle 16 and drawbar 21 assembly. Likewise, if the blade circle 16 and drawbar 21 assembly is raised by cylinders 18 and 18', the follower 32 is driven downward to provide a change in the output of 78 which causes the hydraulic cylinder 23 to retract rod 43 to lift the front end of the drawbar 21 to maintain the horizontal orientation of the blade circle 16 and drawbar 21 assembly.

The cylinders 18, 18' and 23 are of conventional design and the valves 66, 75 and 82 may be V7059 valves manufactured by Honeywell Inc.

Certain changes can, of course, be made in the apparatus shown in the drawings without departing from the scope of the invention which is to be limited only by the appended claims.

The embodiments of the invention in which an exclusive property or right is claimed are defined as follows:

1. In an earth working machine having a main frame and a support assembly for supporting an earth working tool to the main frame, a control system for controlling the horizontal orientation of the support assembly comprising:

a cam surface and cam sensor means adapted to be mounted between the main frame and the support assembly, said cam sensor means having a cam follower for following said cam surface to provide a control signal dependent upon deviations of said support assembly from a prescribed horizontal orientation, said cam surface contoured to predetermine the horizontal orientation of said support assembly; and, control means connected to said cam sensor means by a circuit means, said control means receiving said control signal through said circuit means to produce an output therefor proportional to said control signal to control the horizontal orientation of the support assembly.

2. In the system of claim 1 wherein said earth working machine is a grader and said support assembly comprises a drawbar having one end for supporting a blade circle and grader blade and a second end and a linkage including a motive means for connecting the second end of the drawbar to the main frame of the grader, said control means comprising means adapted to connect said cam sensor means to said motive means for maintaining said prescribed horizontal orientation of said drawbar and blade circle assembly.

3. The system of claim 2 wherein said control means comprises grade sensor means, slope sensor means, first amplifier means connecting said grade sensor means to a first means adapted to control the grade of said earth working tool, second amplifier means connecting said slope sensor to second means adapted to control the slope of said earth working tool, third amplifier means responsive to the cam follower adapted to control the horizontal orientation of said support assembly, first connecting means connecting said first amplifier means to said second amplifier means and second connecting means connecting said first amplifier means to said third amplifier means.

4. The system of claim 2 wherein said cam surface is adapted to be mounted on said support assembly and said cam sensor means is adapted to be mounted on said main frame.

5. The system of claim 4 wherein said control means comprises grade sensor means, slope sensor means, first amplifier means connecting said grade sensor means to a first means adapted to control the grade of said earth working tool, second amplifier means connecting said slope sensor to second means adapted to control the slope of said working tool, third amplifier means responsive to the cam follower adapted to control the horizontal orientation of said support assembly, first connecting means connecting said first amplifier means to said second amplifier means and second connecting means connecting said first amplifier means to said third amplifier means.

6. The system of claim 5 wherein said control system is proportional.

7. In an earth working machine having a main frame and a support assembly for supporting an earth working tool to the main frame, a control system for controlling the horizontal orientation of the support assembly comprising:

a cam surface and cam sensor means mounted between the main frame and the support assembly, said cam sensor means having a cam follower for following said cam surface to provide a control signal dependent upon deviations of said support assembly from a prescribed horizontal orientation, said cam surface contoured to predetermine the horizontal orientation of said support assembly; and, control means connected to said cam sensor means by a circuit means, said control means receiving said control signal through said circuit means to produce an output therefor proportional to said control signal to control the horizontal orientation of the support assembly.

8. In the system of claim 7 wherein said earth working machine is a grader and said support assembly comprises a drawbar having one end for supporting a blade circle and grader blade and a second end and a linkage including a motive means for connecting the second end of the drawbar to the main frame of the grader, said control means comprising means adapted to connect said cam sensor means to said motive means for maintaining said prescribed horizontal orientation of said drawbar and blade circle assembly.

9. The system of claim 8 wherein said control means comprises grade sensor means, slope sensor means, first amplifier means connecting said grade sensor means to a first means to control the grade of said earth working tool, second amplifier means connecting said slope sensor to second means to control the slope of said earth working tool, third amplifier means responsive to the cam follower to control the horizontal orientation of said support assembly, first connecting means connecting said first amplifier means to said second amplifier means and second connecting means connecting said first amplifier means to said third amplifier means.

10. The system of claim 8 wherein said cam surface is mounted on said support assembly and said cam sensor means is mounted on said main frame.

11. The system of claim 10 wherein said control means comprises grade sensor means, slope sensor means, first amplifier means connecting said grade sensor means to a first means to control the grade of said earth working tool, second amplifier means connecting said slope sensor to second means to control the slope of said earth working tool, third amplifier means responsive to the cam follower to control the horizontal orientation of said support assembly, first connecting means connecting said first amplifier means to said second amplifier means and second connecting means connecting said first amplifier means to said third amplifier means.

* * * * *